United States Patent [19]

Johnson

[11] Patent Number: 5,071,119

[45] Date of Patent: Dec. 10, 1991

[54] ABDOMINAL EXERCISE DEVICE

[76] Inventor: Martin W. Johnson, Rte. 1, Box 95, Portland, N. Dak. 58274

[21] Appl. No.: 621,639

[22] Filed: Dec. 3, 1990

[51] Int. Cl.[5] ..... A63B 21/008

[52] U.S. Cl. ..... 272/130; 272/141

[58] Field of Search ..... 272/130, 141, 93, 144

[56] References Cited

U.S. PATENT DOCUMENTS

| | | | |
|---|---|---|---|
| 2,494,094 | 1/1950 | Horstman | 272/141 X |
| 4,211,404 | 7/1980 | Blowsky et al. | 272/141 |
| 4,824,105 | 4/1989 | Goldenberg | 272/130 |
| 4,834,366 | 5/1989 | Hotchkiss | 272/141 X |
| 4,863,162 | 9/1989 | Neckamm et al. | 272/141 X |
| 4,865,317 | 9/1989 | Hickey | 272/141 |
| 4,951,941 | 8/1990 | Resk | 272/130 |

FOREIGN PATENT DOCUMENTS

| | | | |
|---|---|---|---|
| 1012574 | 6/1977 | Canada | 272/141 |

*Primary Examiner*—Richard J. Apley
*Assistant Examiner*—L. Thomas
*Attorney, Agent, or Firm*—Kinney & Lange

[57] ABSTRACT

An exercise device for exercising abdominal muscles and lower back muscles without putting undue stress on lumbar and cervical spinal discs and without over-exercising the hip flexor muscles is for use by a person sitting on a chair. The device includes a pushbar supported on a vertical column including a compression spring means. This column is supported on the floor. The person exercising sits with his or her chin at the height of a horizontally positioned pushbar, puts his or her arms over the pushbar and performs a trunk curl against the resistive force of the spring. The exerciser curls his trunk against the resistive force, holds it for a second, twists to the right and left, and then very slowly allows the resistive force to push the trunk upward to resume the original upright position.

4 Claims, 3 Drawing Sheets

22
12
20
10
18
24
26
27
36
48
40
42
30
70
72
32
34
14
28
16
62
46
44
50
38
74
64
68
60
66

Fig. 5
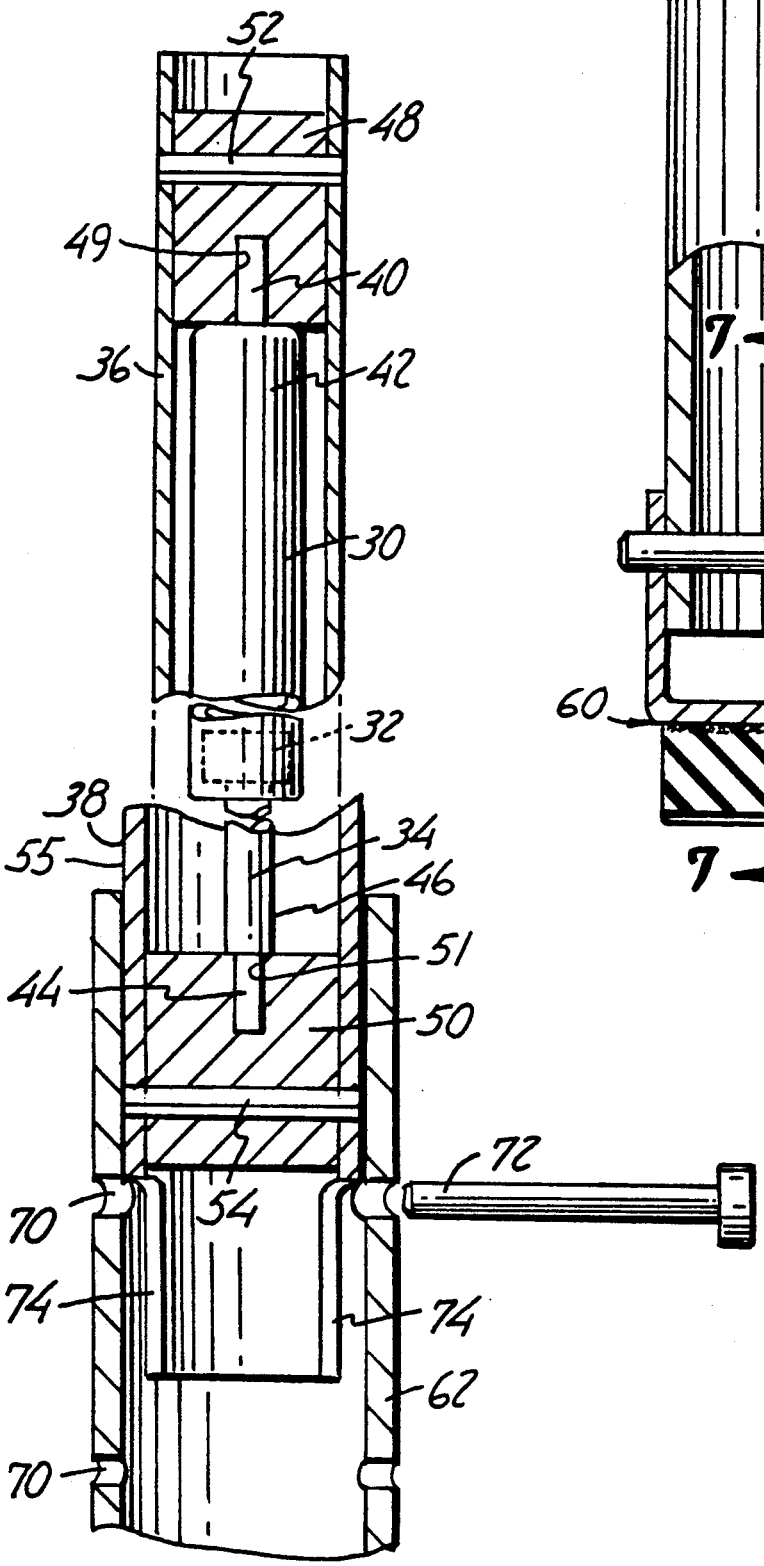
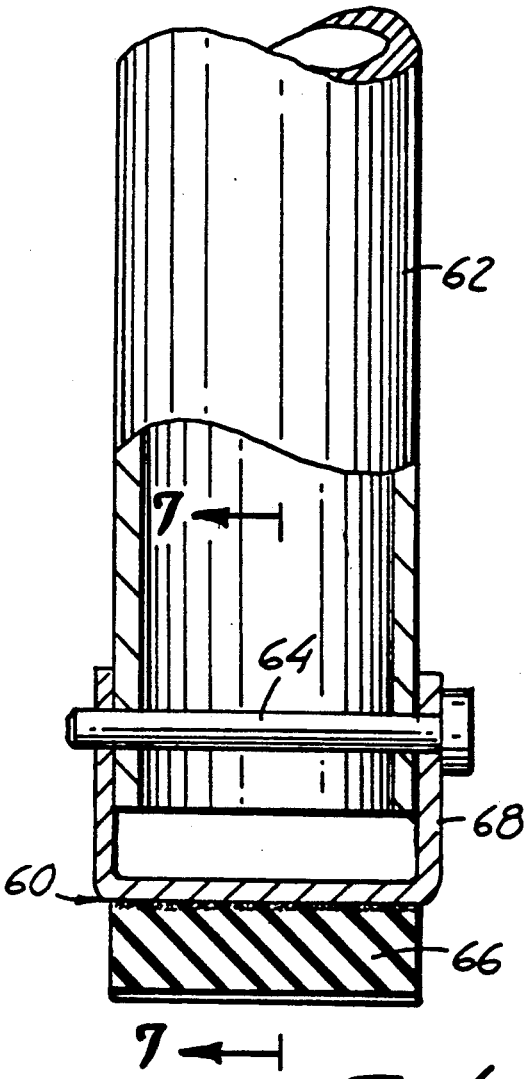
Fig. 6

ABDOMINAL EXERCISE DEVICE

BACKGROUND OF THE INVENTION

This invention has relation to an exercise device for exercising the abdominal muscles and the lower back muscles without putting undue stress on the lumbar and cervical spinal discs and without over-exercising the hip flexor muscles.

"It has long been known that sit-up type exercises are beneficial to the abdominal area. However, it is now known that the standard sit-up exercise consisting of raising the trunk to a sitting position from a supine position with the legs remaining straight causes undue stress and trauma to the lower back regions." See U.S. Pat. No. 4,902,003 granted to Buoni on Feb. 20, 1990, column 1, beginning on line 26.

The basic disadvantage of the sit-up method of exercising the abdominal muscle group is that hip flexor muscles play a prominent role in this movement. A second disadvantage is that one must lie on the floor to perform the movement and the third disadvantage is that it is difficult to control or adjust the resistance. There are a number of "special purpose" devices currently on the market advertised to exercise the abdominal muscle group. As to many of these devices, there is a serious question as to whether they do strengthen the abdominal muscle group.

There are on the market today many legitimate devices sold for the express purpose of exercising the abdominal muscle group. There are such devices that do work the abdominal muscles and are available for the commercial gym as well as for home use. However, the disadvantage of these devices is the size of many of them as well as the cost.

Back injury and pain is the largest single musculoskeletal problem affecting mankind. Expenditures in the neighborhood of one billion dollars are made in this country each year on back disorders.

The main reason for all of these low back problems in man is the strength imbalance between hip flexor muscles and the abdominal muscles. It is estimated that as much as 85% of all low back problems are due to weak abdominal muscles. There are two groups of muscles directly involved in performing such exercises as sit-ups and leg raises. They are the trunk flexors and hip flexors. The abdominal muscles attach to the front and sides of the rib cage and the pelvis; they do not cross the hip joint. A main purpose of these muscles is to stabilize the pelvis and chest so that other muscles can move the arms and legs or fix parts of the trunk in desired movements. The trunk flexors and hip flexors are not directly involved in the movements of the hips. Many persons perform various sit-ups and even weighted sit-ups in an effort to balance the development of the trunk flexors and the hip flexors. However, any abdominal exercise performed with the feet anchored with rollers or a strap is predominantly hip flexion, and the key factor is that it is *TRUNK FLEXION* that activates the abdominals.

Abdominal exercises which are predominantly hip flexion are undesirable for at least two reasons. First, the hip flexions are naturally seven times stronger than the abdominals, and further strengthening of these muscles can result in hip flexor-abdominal imbalance, manifested in an exaggerated anterior pelvic tilt and lumbar curve (lordosis). Second, since the abdominals are receiving minimal work, they cannot generate the force to counter the antagonistic erector spinae group which, when coupled with the strength and adaptive shortening of the hip flexors (which occurs as a result of the performance of an incorrect sit-up exercise) leads to a loss of structural integrity and to postural deviations.

In addition to the patent to Buoni, above identified, U.S. Pat. No. 4,867,445 granted to Connelly on Sept. 19, 1989, shows a resistance device for use in chairs. This device does not use the muscle groups for which this present invention was developed. The same can be said of U.S. Pat. No. 4,618,140 granted to Brown on Oct. 21, 1986.

U.S. Pat. No. 4,666,152 granted to Jones on May 19, 1987 shows a device for exercising the abdominal muscles but without utilizing the concepts of the present invention. The same can be said of U.S. Pat. No. 3,912,265 granted to Muir on Oct. 14, 1975.

The following U.S. Pat. Nos. were located during a patent search relative to the present invention; but are not believed to be pertinent to that invention: 4,834,364 granted to Gongwer et al on May 30, 1989; 4,824,105 granted to Goldenberg on Apr. 25, 1989; 4,807,873 granted to Naquin on Feb. 28, 1989; and 4,641,833 granted to Trethewey on Feb. 10, 1987.

What was needed before the present invention was a device to exercise the abdominal and lower back muscles without undue stress on lumbar and cervical spinal discs and without over-exercising the hip flexor muscles. Also needed was such a device which is a very inexpensive, easily portable so that the exerciser can actually carry the device conveniently on travel away from home base, and which can be very easily adjusted to provide additional resistance as the user develops additional strength through the exercising.

SUMMARY OF THE INVENTION

An exercise device for use with a chair standing on a floor includes a base assembly fixedly supported with respect to the floor in immediately adjacent relationship to the chair; a generally horizontal pushbar; and an elongate, generally vertical, generally columnar means for generating resistive forces responsive to externally applied forces on the pushbar. The resistive means includes a first vertically movable upper end portion supporting the pushbar and a second lower end portion fixedly supported on the base assembly to prevent relative vertical movement of the second end portion of the resistive means with respect to the floor.

BRIEF DESCRIPTION OF THE DRAWINGS

FIG. 5 is an enlarged, fragmentary, vertical sectional view of an upper portion of a means for generating resistive forces according to the invention;

FIG. 6 is a fragmentary enlarged partly cross-sectional view of a lower portion of the means for generating resistive forces.

DETAILED DESCRIPTION OF THE PREFERRED EMBODIMENTS

An exercise device 10 is for exercising abdominal muscles and lower back muscles without putting undue stress on lumbar and cervical spinal discs and without over-exercising the hip flexor muscles. The exercise device includes a generally horizontal padded pushbar 12, a resistive force generating means assembly indicated at 14 which supports the pushbar 12, and a base assembly 16 which supports the resistive force generating means assembly 14.

Figures 1, 4:
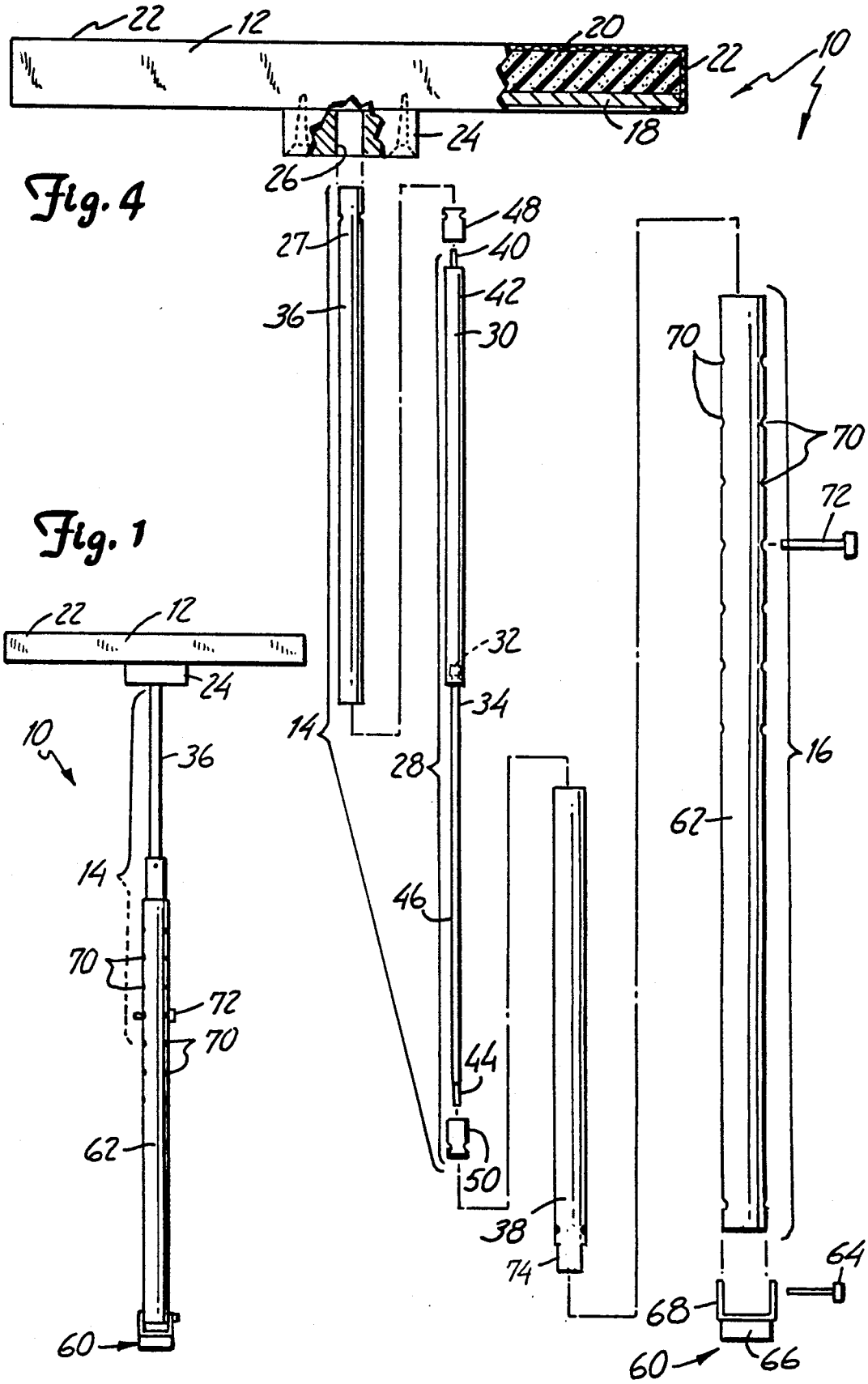
FIG. 1 is a front elevational view of an exercise device of the present invention.
FIG. 4 is an exploded view of various of the elements which make up the exercise device of the invention.

In the form of the invention as shown, the pushbar includes a solid bolster 18 of wood or plastic or the like over which a cushioning layer 20 is applied. These two elements are at least partially covered by a skin layer 22 of leather, flexible plastic sheeting or the like, all as best seen in FIG. 4. A pushbar positioning block 24 extends integrally downwardly from the center of the pushbar 12 and is provided with a spring means positioning socket 26 for receiving a first upper end portion 27 of the resistive force generating means assembly 14.

The resistive force generating means assembly 14 includes a spring means 28 made up of a gas spring cylinder 30, a gas spring piston 32 inside of the cylinder 30, and a gas spring piston rod 34 integral with piston 32 and extending outwardly from cylinder 30. See FIGS. 4 and 5. Alternatively, a mechanical compression coil spring could be used.

The resistive force generating means assembly 14 also includes a gas spring cylinder sleeve 36 situated in surrounding relation to the cylinder 30, and a gas spring piston rod sleeve 38 situated in surrounding relation with respect to, and outside of, the cylinder 30 and its cylinder sleeve 36. A gas spring cylinder positioning stud 40 extends integrally upwardly from a first vertically movable upper end portion 42 of the cylinder 30; and a gas spring piston rod positioning stud 44 extends integrally downwardly from a second lower end portion 46 of the gas spring piston rod 34.

A cylindrical gas spring cylinder positioning block 48 is provided with a suitable socket 49 to receive the cylinder positioning stud 40; and a cylindrical piston rod positioning block 50 is provided with a socket 51 to receive the piston rod positioning stud 44. The outside diameter of cylinder positioning block 48 is the same as the inside diameter of the cylinder sleeve 36. Appropriate transverse openings are provided in cylinder positioning block 48 and cylinder sleeve 36 to receive a roll pin 52 to fixedly position the sleeve 36 and the cylinder 30 with respect to each other. In this manner, the first vertically movable upper end portion 42 of cylinder 30 becomes one with the first upper end portion 27 of the assembly 14.

The outside diameter of the piston rod positioning block 50 is the same as the inside diameter of the piston rod sleeve 38, and openings are provided through each of these elements to receive a roll pin 54 to fixedly position the piston rod 34 with respect to the piston rod sleeve 38, making second lower end portion 46 of piston rod 34 one with a second lower end portion 55 of the assembly 14.

Figure 7:
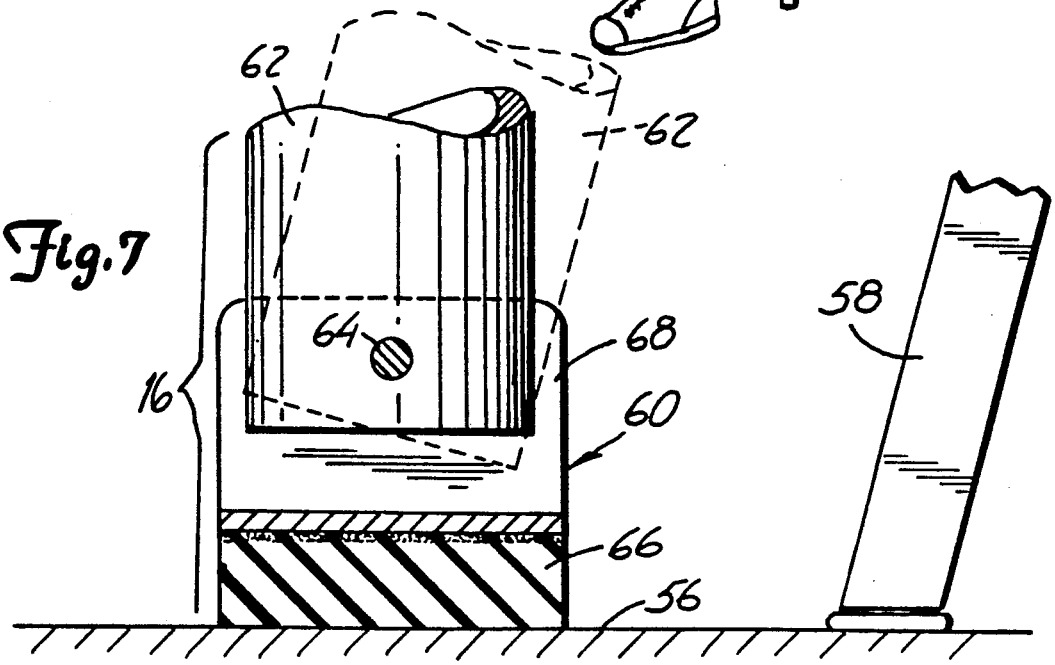
FIG. 7 is an enlarged vertical sectional view taken generally on the line 7—7 in FIGS. 1 and 6.

The base assembly 16 supports the second lower end portions 46 and 55 of the piston rod 34 and the resistive force generating means assembly 14 to prevent relative vertical movement of this second end portion with respect to a floor 56. Also supported on floor 56 is a sturdy chair 58. As best seen in FIGS. 6 and 7, the base assembly includes a foot 60 and a base support column 62 pivotally mounted to the foot 60 as at 64. As best seen in FIGS. 6 and 7, the foot 60 consists of a non-skid pad 66 and a U-shape bracket 68 extending upwardly from the pad.

The support column 62 is provided with a plurality of pairs of transverse piston rod sleeve support pin openings 70,70 therethrough, each pair being adapted to snugly receive a piston rod sleeve support pin 72. As best seen in FIG. 6, the lowermost end portion of the piston rod sleeve 38 is provided with a pair of vertical slots 74,74 which can be positioned to be in alignment with the support pin 72 when it is inserted through a pair of the support pin openings 70,70.

In the form of the invention as shown, the base assembly 16 is supported on the floor 56 to prevent any vertical downward movement of the gas spring piston rod 34 when force is exerted on the pushbar 12. The invention would work effectively, however, if the base assembly was supported instead directly on a forward projection from the chair 58, for example.

METHOD OF USE

Figure 2:
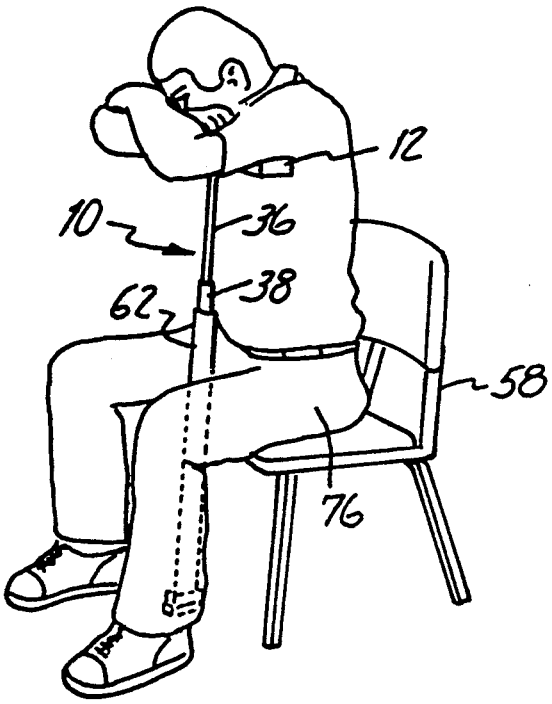
FIG. 2 is a perspective view of the exercise device of FIG. 1 shown in its initial position for use by a person sitting on a chair.

With the resistive force generating means assembly 14 assembled to the pushbar 12, the piston rod sleeve 38 will be inserted into the upper end of the base support column 62 and moved to position the pushbar 12 at approximately chin height for a person 76 sitting upright on chair 58 as seen in FIG. 2. Maintaining the pushbar at about that same height with respect to the base support column 62, the piston rod sleeve support pin 72 will be inserted through the closest openings 70,70 available to maintain that height. The piston rod sleeve 38 will then be rotated as necessary to align the slots 74,74 so that they encompass the support pin 72 and the exercise device 10 is ready to use.

Figure 3:
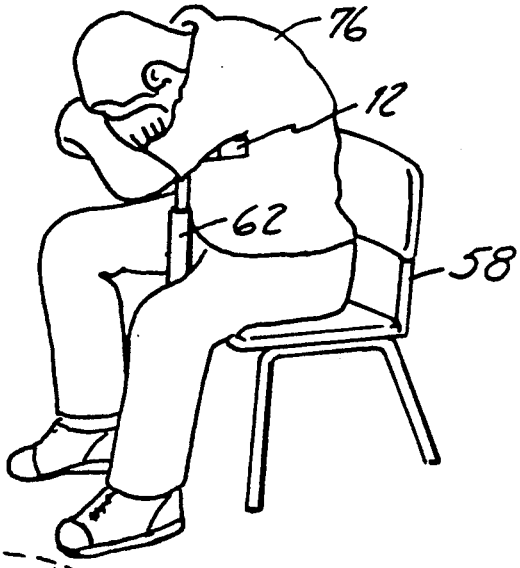
FIG. 3 is a view similar to FIG. 2 but with that person having pushed the exercise device into a condition where it has generated its maximum resistive force.

With the resistive force generating means assembly 14 including the spring means 28 situated in perpendicular relationship to the floor, the person 76 who is to do the exercising will place his or her arms over the padded pushbar 12 and push the bar down with the chin resting on the pushbar and while looking down at the floor. During this downward push, the person will curl the upper trunk downward without leaning forward. When the position of maximum resistance is achieved as seen in FIG. 3, the piston 32 will have reached its upper limit of movement within the cylinder 30. The device 10 will be retained in that position for the count of one (a second or so). Then the person exercising will rotate the trunk to the left and then to the right and then back to the middle position. He or she will next allow the resistive force developed in the spring means 28 to slowly return the pushbar and the arms back to the position as seen in FIG. 2 with the piston 32 against the rod end of the cylinder 30.

To achieve maximum favorable results, the exerciser 76 will slowly exhale throughout the downward curl and the twisting phase of the movement, and will begin inhaling as the pushbar moves upward. After reaching the starting position of FIG. 2, the exerciser will take a deep breath and begin the next repetition. This repetition will begin immediately so that the abdominal muscles remain tense throughout the entire set of repetitions.

Initially, the exerciser will maintain the vertical position of the spring means 28 throughout the exercise by performing a "curl" and without leaning forward. The feet are not anchored in any way so the exerciser will let the legs rise slightly as the forward curl is occurring. This tends to work both the upper and lower abdominals more completely.

The concentration is on exhaling as the force is exerted. Holding one's breath while exercising is not advised.

Depending on the prior conditioning of the exerciser, the exercise program can begin with one set of from 10 to 15 repetitions daily. The number of sets may be increased to 2 to 5 per day and also the repetitions per set may be increased to a recommended maximum limit of 30 repetitions per set.

As the exerciser becomes stronger and can more easily complete the prescribed number of repetitions, the resistance of the exercise device 10 is increased by moving the foot 60 farther away from the chair 58 so that the spring means and the basic support column 62 remain in a vertical plane, but will have an angle similar to that taken by the column 62 as seen in dotted lines in FIG. 7. The more of an angle, the more force necessary to perform the exercise.

Although the present invention has been described with reference to preferred embodiments, workers skilled in the art will recognize that changes may be made in form and detail without departing from the spirit and scope of the invention.

What is claimed is:

1. An exercise device for use with a chair standing on a floor, said device including:

a base assembly having a non-skid foot and a hollow upwardly open base support column connected to the foot and extending upwardly therefrom;

a generally horizontal push bar provided with a centrally located downwardly extending positioning block provided with a downwardly open positioning socket;

an elongate, generally vertical, generally columnar means for generating resistive forces responsive to externally applied forces, said columnar means including a first vertically movable upper end portion supporting the push bar and a second lower end portion fixedly supported on the base assembly to prevent relative vertical movement of the second end portion of the columnar means with respect to the chair;

wherein the columnar means embodies a tubularly encased spring means offering a relatively constant resistance to downward movement as the push bar is forced down toward the base assembly, and providing a relatively constant bias toward upward movement as the pushbar is allowed to move up;

wherein the spring means is a gas spring including a gas filled cylinder, a piston in that cylinder and a piston rod extending from the piston to outside the cylinder, one of the cylinder and the piston rod providing the first upper end portion of the spring means and the other providing the second lower end portion thereof;

wherein the columnar means includes a cylinder sleeve encompassing the gas-filled cylinder and integrally connected to an upper end portion of the gas-filled cylinder, an upper end portion of the cylinder sleeve being of configuration to be received within the pushbar positioning socket, the resistive means also includes a piston rod sleeve encompassing the piston rod and lying in overlapping telescopic relationship with respect to the cylinder sleeve and integrally connected to a lower end portion of the piston rod, the piston rod sleeve being of size and configuration to fit within the base support column; and means to fasten a lower end portion of the piston rod sleeve to the base support column, said means including openings in the base support column and in the lowermost portion of the piston rod sleeve and a piston rod sleeve support pin to fit through said openings.

2. The device of claim 1 and further including means to limit the distance the first end portion of the spring means can move toward and away from its second end portion.

3. The exercise device of claim 1 wherein the base support column is provided with a plurality of vertically spaced pairs of piston rod sleeve support pin openings therethrough so that the overall length of the exercise device can be adjusted to proper height to position the support bar at an appropriate level with respect to a person sitting upright on a chair to use the device.

4. The exercise device of claim 1 wherein the base support column is pivotally connected to the foot.

* * * * *